US005748106A

United States Patent [19]

Schoenian et al.

[11] Patent Number: 5,748,106

[45] Date of Patent: May 5, 1998

[54] METHOD AND APPARATUS FOR CONTROLLING TRANSPONDER SIGNALING

[75] Inventors: Richard J. Schoenian, Kokomo; Alan Lee Strader, Noblesville, both of Ind.

[73] Assignee: Delco Electronics Corp., Kokomo, Ind.

[21] Appl. No.: 622,530

[22] Filed: Mar. 25, 1996

[51] Int. Cl.[6] ..... G08G 1/00

[52] U.S. Cl. ..... 340/928; 340/311.1; 455/38.4; 379/76

[58] Field of Search ..... 340/928, 825.44, 340/825.47, 311.1; 455/38.4, 38.1; 379/71, 67, 76

[56] References Cited

U.S. PATENT DOCUMENTS 4,975,694 12/1990 McLaughlin ..... 340/825.44
5,012,219 4/1991 Henry ..... 340/311.1
5,192,947 3/1993 Neustein ..... 340/825.44
5,235,327 8/1993 Igarashi et al. ..... 340/825.07
5,239,679 8/1993 Murai ..... 340/311.1
5,602,538 2/1997 Orthmann et al. ..... 340/825.54

*Primary Examiner*—Jeffery Hofsass
*Assistant Examiner*—Julie B. Lieu
*Attorney, Agent, or Firm*—Mark A. Navarre

[57] ABSTRACT

A battery powered transponder in a vehicle for communicating with a toll station or weigh station lights one of a few LEDs to indicate whether a bypass of the station is authorized or denied. A transmit/receive circuit sends data to an IC which signals the instruction to a microprocessor which is programmed to activate the proper LED when so instructed for a short period and then maintains a recall state for a long period. A pushbutton switch connected to the microprocessor, if operated within the long period, triggers a replay of the proper LED to verify the instruction while minimizing power consumption.

6 Claims, 3 Drawing Sheets

METHOD AND APPARATUS FOR CONTROLLING TRANSPONDER SIGNALING

FIELD OF THE INVENTION

This invention relates to transponders for vehicles and particularly to controlling indicators of such transponders after a transmitted control signal has expired.

BACKGROUND OF THE INVENTION

Transponder systems are available in which a roadside control agency such as a toll station or a truck weigh station can communicate with an approaching vehicle to determine whether the vehicle is required to stop or may be permitted to pass. The roadside station transmits to and receives signal from a transponder mounted in the vehicle and signals whether a bypass is allowed or denied.

In the case of a weigh station, the transponder may be loaded with data regarding when and where the vehicle was last weighed and the recorded weight. If there has not been sufficient elapsed time since the last weighing for the load to have been increased, the bypass is allowed. In some cases scales in the roadway are available to check the weight on-the-move, and this information also is used to decide bypass permission. In the case of a toll station, prepaid toll payments may be stored in the transponder and suitable amounts are subtracted at each toll station. When sufficient balance is present in the account and the transaction is successful, bypass permission is given.

When the roadside station grants or denies bypass permission, a short signal to the transponder causes a green or a red light to flash for a minute or two and a beeper to sound, thereby apprising the driver of the permission status. To enforce compliance with bypass denial, police may, on occasion, stop the vehicle and view the transponder light to verify whether bypass permission was granted. To allow enforcement personnel sufficient time to pull over a suspected violator, the ability to verify the signal should continue for fifteen minutes after the signal is first given.

The transponder may be wired to the vehicle circuit, but to avoid that expense it is preferred that the transponder be powered by an internal battery. Then the installation amounts to merely attaching the device to the windshield of the vehicle. A secondary effect of using an internal battery is that the power consumption must be limited to sustain a long battery life. Typically, the signaling is limited to a short period to conserve battery life.

It is desirable to minimize the power consumption of a battery powered transponder and at the same time to offer the full benefits of the authorization signal including the ability to verify the signal within fifteen minutes of receipt of the signal so that the status can be verified.

SUMMARY OF THE INVENTION

It is therefore an object of the invention to minimize power consumption in a battery powered transponder while maintaining full transponder functions.

A battery powered transponder includes a transmit and receive circuit for communicating with a roadside station. An integrated circuit linked with the transmit and receive circuit stores the pertinent data and issues control signals as a result of received commands. The control signals are for a red indicator light to deny bypass, a green indicator light to allow bypass, and a yellow light for special purposes such as notification of a low toll balance or of a message for the driver.

A microprocessor receives the control signals and activates red, green or yellow LEDs. Yellow signals are not pertinent to enforcement and need to last for only 5 seconds. Red or green signals flash in one pattern of pulses (along with a beeper) for five seconds and in another pattern for up to two minutes. Then the LEDs are turned off to save power but if a recall/test pushbutton switch is actuated within the next thirteen minutes, the first pattern of red or green pulses is repeated for five seconds. Thus verification can be obtained for a recall period after the initial signal without continuous LED operation for that period. The recall/test switch may be operated after the recall period expires; then the LEDs and the beeper are activated for a brief test period.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

A transponder used primarily for heavy trucks traveling on toll roads or roads having weigh station communicates with roadside transceivers operated by toll or weigh stations. The transceivers interrogate the transponder to receive data regarding the truck identity and other information such as the balance in the toll account, or the last time and place of weighing and the weight. The transceiver also sends data to the transponder for storage therein, as well as a command to inform the driver whether bypass is authorized or denied. When weigh station bypass is authorized, the truck may remain on the main highway to avoid stopping, and if denied, the truck must stop at the weigh station. In the case of toll stations, some require the truck to always stop and then continue without manual transactions; others perform the electronic transaction without requiring stopping.

Figure 1:
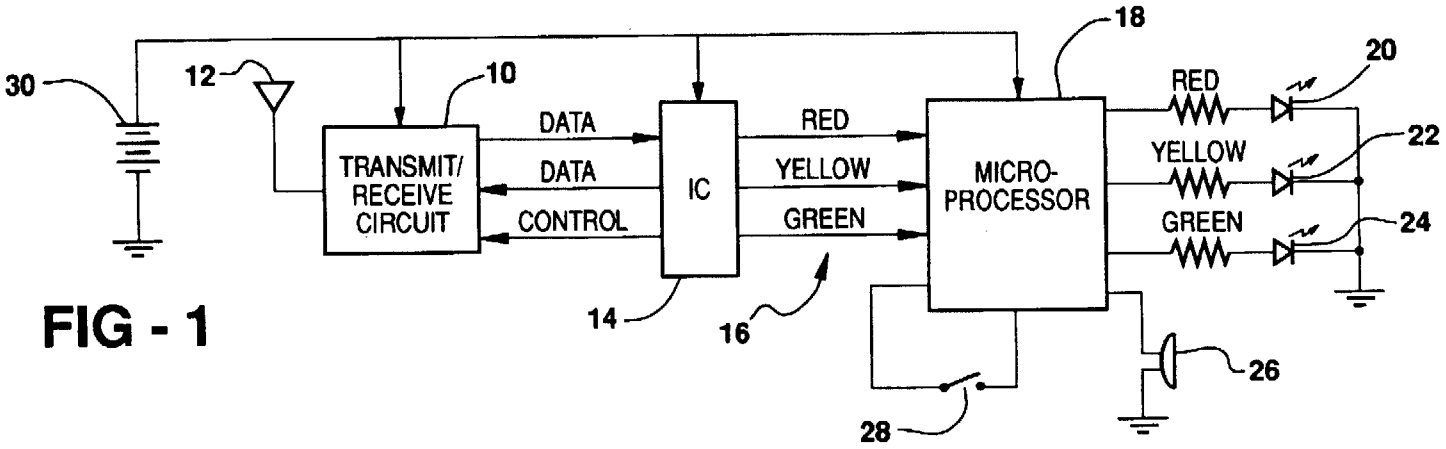
FIG. 1 is a block diagram of a transponder according to the invention.

As shown in FIG. 1 the transponder includes a transmit/receive circuit 10 coupled to an antenna 12. The circuit outputs data to an application specific integrated circuit (IC) 14 which in turn sends data and control signals to the circuit 10. Such an IC is available as an ETOL Custom IC from Delco Electronics Corp., Kokomo, Ind. The IC 14 implements a VRC (vehicle roadside communication) protocol which is especially adapted to store and supply the necessary data for the communication with the roadside unit, and interprets the data to issue a command for a red, green or yellow indicator on control lines 16. The control lines 16 are connected to input ports of a microprocessor 18 which is programmed to selectively activate output ports coupled to a red LED 20, a yellow LED 22, a green LED 24 and a beeper 26. A manually operated recall/test switch 28 is also connected to the microprocessor 18. Thus when the IC 14 activates a control line, the microprocessor effects illumination of the corresponding LED. An internal battery 30 is connected to the transmit/receive circuit 10, the IC 14 and the microprocessor 18. Although the microprocessor is shown as a separate element, it or its processor function may be incorporated as part of the IC 14. In any event a processor for performing the required algorithm is provided either in the IC or separately.

Figure 2:
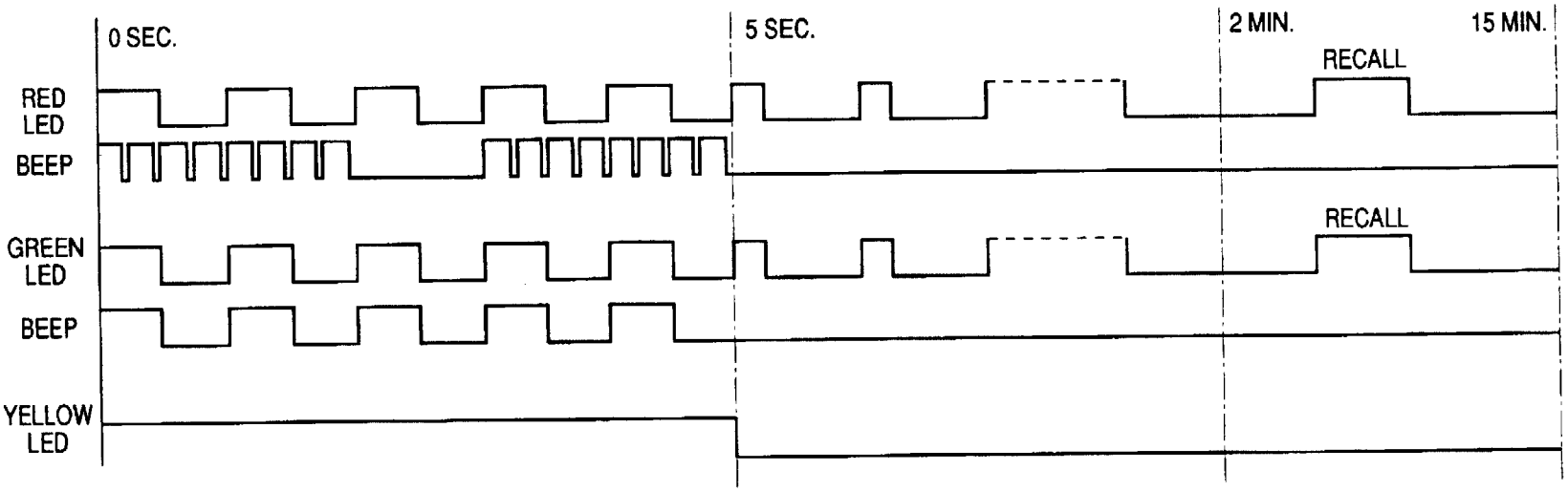
FIG. 2 is a waveform diagram illustrating LED signal patterns used by the transponder of FIG. 1.

The LEDs and the beeper are the chief energy consumption agents of the system. The microprocessor is programmed to produce patterns of LED and beeper outputs which are effective to clearly convey the necessary message and yet economize power consumption for extended battery life. FIG. 2 comprises waveforms illustrating effective patterns, but it will be recognized that other suitable patterns may be employed. When the yellow control line is activated, the yellow LED 22 is held on continuously for 5 seconds and then turned off. For a red or green signal the LEDs 20 or 24 are flashed intermittently for a time and then are subject to be recalled for an additional time.

As shown in the FIG. 2 waveforms, the green LED, which is used to signal bypass authorization, flashes on and off at 0.5 second intervals for 5 seconds to comprise a first pattern and a first interval. The beeper is turned on and off in the same pattern. For a subsequent interval, from 5 seconds to 2 minutes, the green LED is repeatedly turned on for 250 msec and off for 750 msec to comprise a second pattern. The beeper is not turned on after the first interval. Finally, during a recall interval extending from the 2 minute point to 15 minutes, the first pattern will be repeated by the green LED for 5 seconds if the recall/test switch 28 is closed. The red LED, which is used to signal bypass denial, has the same patterns as the green LED. The beeper, however, has a different pattern during the first interval comprising 200 msec on and 50 msec off.

A test signal, not shown, is activated when the recall/test switch 28 is closed when the transponder is not in a signaling mode. Thus if the switch is closed at any time outside the period of actual or potential signaling, each LED, in turn, will be flashed on for 0.5 sec along with the beeper to verify transponder operability.

Figures 3A, 4:
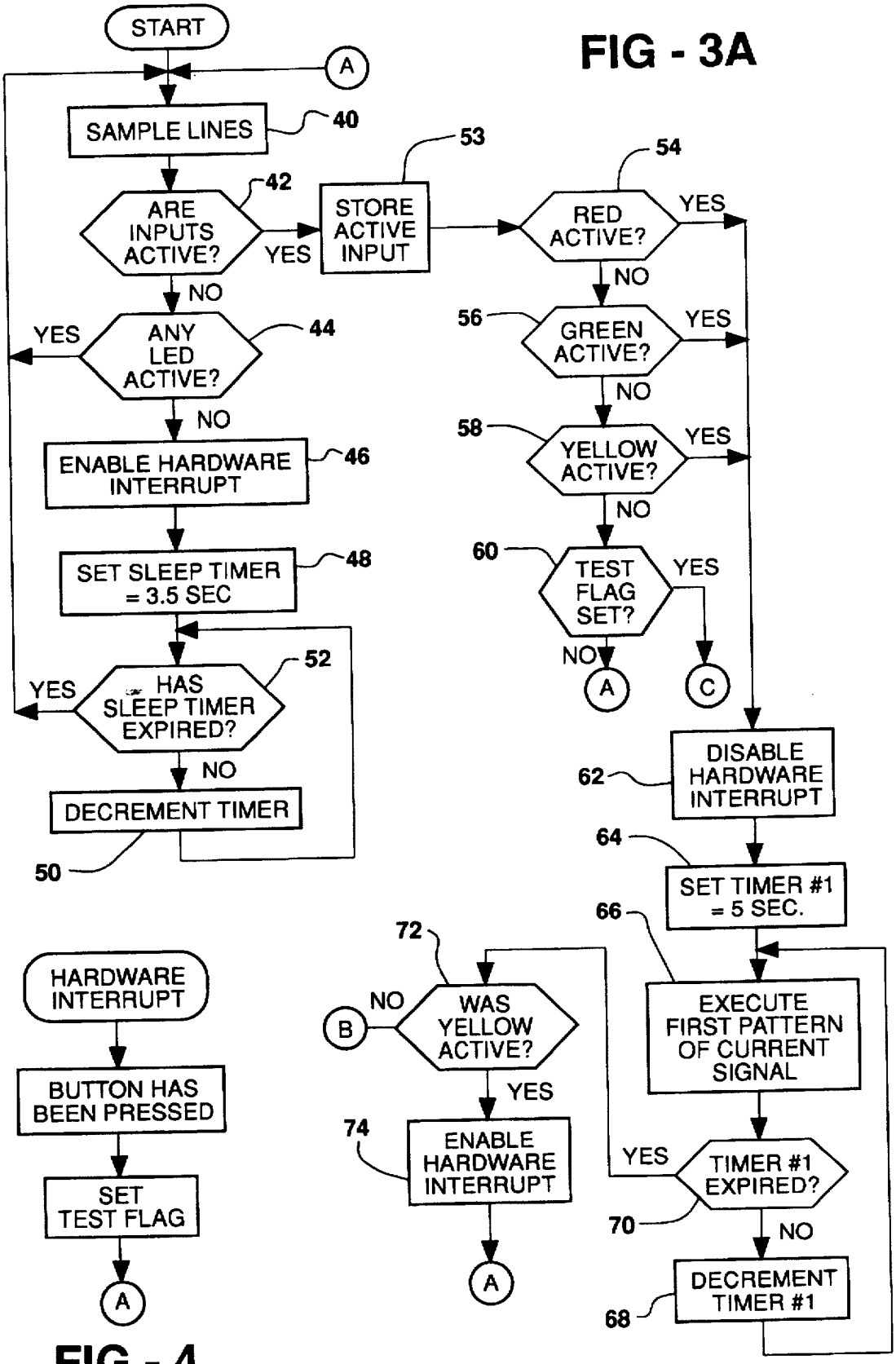
FIGS. 3A, 3B, 3C and 4 are flow diagrams representing the program for operation of the transponder microprocessor.
Figure 3B:
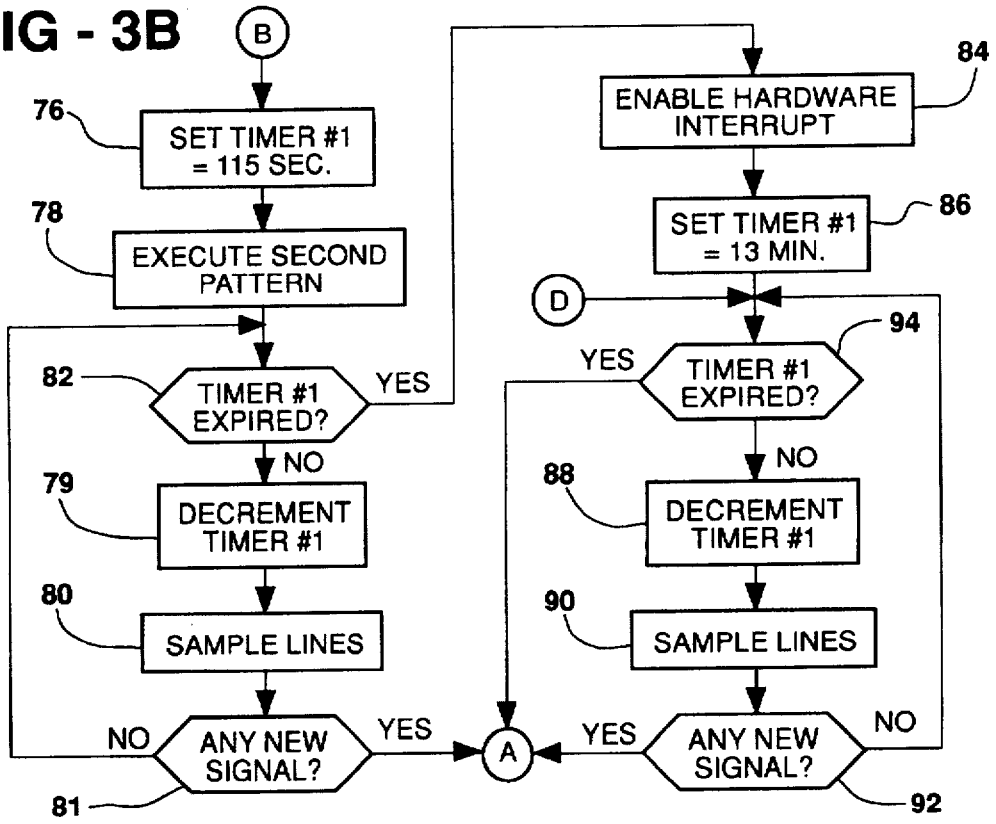
Figure 3C:
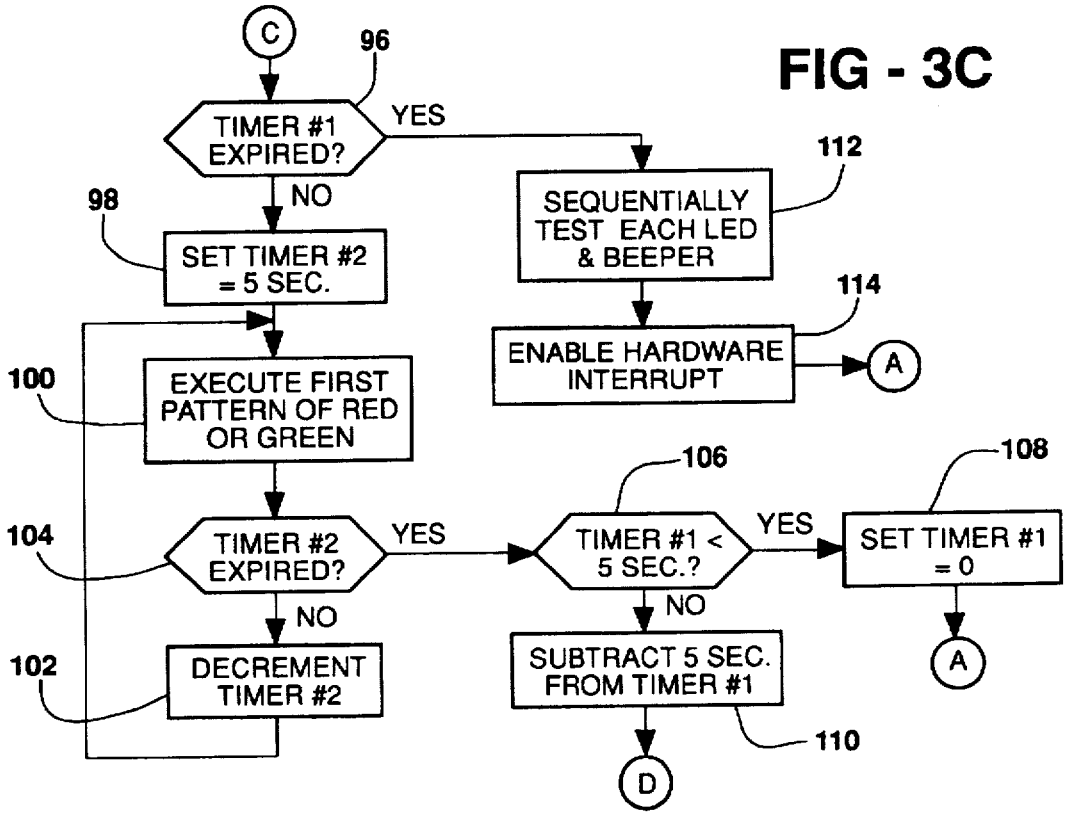

The microprocessor program is represented by the flow charts wherein the functional description of each block in the charts is accompanied by a number in angle brackets <nn> which corresponds to the reference number of the block. FIGS. 3A–3C represents the main program and comprise one flow diagram interconnected at nodes A–D. FIG. 4 represents a hardware interrupt routine which indicates that the pushbutton switch 28 has been closed <36> and sets a TEST FLAG <38>, provided that the main program allows a hardware interrupt.

The main program is entered at START in FIG. 3A. The control lines 16 are sampled <40> to determine if any line is currently activated <42>. If not, it is determined whether any LED is active <44>, that is, executing its first or second pattern within the first period less than 2 minutes. If so, the program returns to the beginning (node A). If not, the hardware interrupt is enabled <46>, and a sleep timer is set to 3.5 seconds <48>. Then the sleep timer is decremented <50> until its time has expired <52> and then the program returns to the start.

When a control input is active <42>, the active input is stored <53>, and it is determined which control line is active, the red line <54>, the green line <56> or the yellow line <58>. If none is active the TEST FLAG is checked <60>; if it is not set the program returns to the start, and if is set it goes to node C. However, assuming one of the control lines is active <54–58>, the hardware interrupt is disabled <62> so that the pushbutton switch 28 will be ineffective. Next a timer #1 is set to 5 seconds <64>, the first pattern of the current signal, as shown in FIG. 2, is started and continued <66> while the timer is decremented <68>. When timer #1 expires <70>, if the yellow line was active <72> the hardware interrupt is enabled <74> and the program returned to the start. If yellow was not active <72>, (referring to node B, FIG. 3B) timer #1 is set to 115 seconds <76> and the second pattern is executed <78> while the timer is decremented <79>. While the timer is timing out the lines are sampled <80>. If any new signal is detected <81>, the program returns to node A or START, FIG. 3A. When the timer #1 is expired <82>, the hardware interrupt is enabled <84> and timer #1 is set to 13 minutes <86> to enter the recall interval which allows the pushbutton switch to command a display of the current color light. While the timer is being decremented <88> the lines are sampled for a new signal <90> and if a new signal occurs <92> or the timer #1 expires <94> the program returns to the start.

If the pushbutton switch 28 is actuated while the hardware interrupt is enabled, the TEST flag is set as shown in FIG. 4. This may occur during the 13 minute timer interval to recall the current signal or after that interval has expired to test the apparatus. The flag is detected in block 60 in FIG. 3A. Then, referring to node C in FIG. 3C, if the timer #1 has not expired <96> (and thus is in the 13 minute interval), timer #2 is set to 5 seconds <98> and the first pattern of red or green is executed <100> as the timer is decremented <102>. When timer #2 expires <104>, if the timer #1 has less than 5 seconds remaining <106> it is set to 0 <108> and the program returns to start. If timer #1 has 5 seconds or more, 5 seconds is subtracted <110> to compensate for the time used by timer #2 and the program goes to node D in FIG. 3B to continue the timer #1 operation. When the test button is pressed after the timer #1 has expired <96> each LED with the beeper is turned on in sequence for 0.5 second <112> and the hardware interrupt is enabled <114>.

By providing an initial signal period of two minutes to surely apprise the driver of the bypass instruction and allow sufficient time to react, and to allow recall of the instruction for many minutes afterward, excellent information output is afforded while minimizing LED operation to extend battery life. It will thus be recognized that a transponder for toll and weigh station bypass transactions can be improved by the addition of a microprocessor (or the equivalent function in the IC) and a pushbutton switch to permit long battery life while effectively maintaining each indication for a long interval for verification of the bypass authorization.

The embodiments of the invention in which an exclusive property or privilege is claimed are defined as follows:

1. A battery powered transponder for a vehicle for activating appropriate indicators in response to transmitted data comprising:

a receiver for receiving transmitted data;

a circuit for producing indicator signals in response to the data;

a processor responsive to the indicator signals and coupled to the indicators;

a pushbutton switch coupled to an input of the processor; and the processor is programmed to activate a selected indicator for a predetermined initial display period in response to an indicator signal to display the transmitted data, and deactivate the selected indicator upon expiration of said predetermined initial display period, reactivate the selected indicator for a period when the pushbutton switch is operated within a predetermined reactivation interval following the expiration of said predetermined initial display period; and test the transponder by activating all of the indicators at the same time when the push button switch is operated after the predetermined reactivation interval has expired.

2. The invention as defined in claim 1 wherein:

the predetermined initial display period comprises a first interval of short duration followed by a second interval of longer duration.

3. The invention as defined in claim 1 wherein:

the circuit has a plurality of control lines which are energized to produce the indicator signals; and the processor comprises a microprocessor having inputs connected to the control lines.

4. A method of operating a battery powered transponder for a vehicle for activating a selected one of a plurality of indicators in response to transmitted data, the transponder having a pushbutton switch and the method comprising the steps of:

receiving said transmitted data;

energizing a control line corresponding to the selected indicator;

storing information on which indicator is selected;

activating the selected indicator for a predetermined initial display period in response to energization of said control line to display the transmitted data and deactivating the selected indicator upon expiration of said predetermined initial display period;

reactivating the selected indicator when the pushbutton switch is manually operated within a predetermined reactivation interval following expiration of the predetermined initial display period; thereby to selectively redisplay the transmitted data following the expiration of said predetermined initial display period without continuous activation of the selected indicator during said predetermined reactivation interval; and manually operating the push-button switch after expiration of predetermined reactivation interval to test the operability of the indicators by activating all of the indicators at the same time in response to such manual operation of the push button switch.

5. The invention as defined in claim 4 including:

ignoring operation of said pushbutton switch during the predetermined initial display period.

6. A battery powered transponder for a vehicle for activating appropriate indicators in response to transmitted data comprising:

a receiver for receiving transmitted data;

a circuit for producing indicator signals in response to the data;

a processor responsive to the indicator signals and coupled to the indicators;

a pushbutton switch coupled to an input of the processor; and the processor is programmed in response to an indicator signal to activate a selected indicator in a first pulsed pattern during a first interval of short duration, and thereafter activate the selected indicator in a second pulsed pattern during a second interval of longer duration to display the transmitted data; and reactivate the selected indicator in said first pulsed pattern for a period equal to the first interval when the pushbutton switch is operated within a prescribed reactivation interval following expiration of said second interval;

whereby operating the pushbutton switch following the expiration of said second interval causes the transmitted data to be displayed again without continuous activation of the selected indicator.

* * * * *